US012043931B2

(12) United States Patent
Liu

(10) Patent No.: US 12,043,931 B2
(45) Date of Patent: Jul. 23, 2024

(54) ELASTIC BAND

(71) Applicant: Che-Jui Liu, Changhua (TW)

(72) Inventor: Che-Jui Liu, Changhua (TW)

( * ) Notice: Subject to any disclaimer, the term of this patent is extended or adjusted under 35 U.S.C. 154(b) by 840 days.

(21) Appl. No.: 17/140,081

(22) Filed: Jan. 3, 2021

(65) Prior Publication Data

US 2022/0213623 A1 Jul. 7, 2022

(51) Int. Cl.
*D04B 21/18* (2006.01)
*A45D 8/36* (2006.01)
*D04B 21/02* (2006.01)

(52) U.S. Cl.
CPC ..... *D04B 21/18* (2013.01); *A45D 8/36* (2013.01); *D04B 21/02* (2013.01)

(58) Field of Classification Search
CPC ..... D04B 21/02; D04B 21/04; D04B 21/18; A45D 8/36; D03D 15/56; D03D 27/02; D03D 27/04; D03D 27/06; D10B 2401/061; D10B 2403/0114; D10B 2403/0311
See application file for complete search history.

(56) References Cited

U.S. PATENT DOCUMENTS 4,248,064 A * 2/1981 Odham ..... D04B 21/18 66/190
5,522,240 A * 6/1996 Wall ..... D04B 21/18 66/170
6,155,085 A * 12/2000 Shindo ..... D04B 21/14 66/194
6,910,353 B2 * 6/2005 Sasser ..... A44B 18/0092 66/193
2011/0212659 A1 * 9/2011 Yenici ..... D03D 15/567 139/11
2017/0145608 A1 * 5/2017 Ko ..... D04C 1/08

OTHER PUBLICATIONS

Complete Textile Glossary, Celanese Acetate LLC, 2001.*
Plush Definition, Merriam-Webster, https://www.merriam-webster.com/dictionary/plush, retrieved Nov. 22, 2023.*

* cited by examiner

*Primary Examiner* — Jennifer A Gillett
(74) *Attorney, Agent, or Firm* — Ying-Ting Chen; Law Office of Michael Chen

(57) ABSTRACT

An elastic band may include an elastic weaving body, and a three-dimensional protruding surface is knitted on a front surface of the elastic weaving body while a flat plush surface is knitted on a rear surface thereof. The three-dimensional protruding surface comprises a plurality protruding portions separated with the same interval. When the elastic band is in use, the protruding portions not only can improve the friction coefficient of the surface so as to avoid the elastic band from loosen, but also can be used as ribs on the elastic weaving body to prevent the elastic band from being folded and to keep the elastic band smooth. Also, the three-dimensional protruding surface and the flat plush surface can provide extra soft touch for skin and have the effect of reducing pressure, which greatly improves comfort to wear.

7 Claims, 4 Drawing Sheets

ELASTIC BAND

FIELD OF THE INVENTION

The present invention relates to an elastic band and more particularly to an elastic band with three-dimensional structure.

BACKGROUND OF THE INVENTION

A conventional elastic band comprises a successive weft thread folded into transverse sections, and a plurality of warp threads, which are made of plastic fiber or cotton, together with rubber threads are longitudinally interlaced with the sections of the weft threads to form into the knitted elastic band.

However, the conventional elastic band has following disadvantages: (i) the woven structure of the elastic band is too simple that the stretching and tightening performance made from the interlaced rubber threads can only have one direction, and moreover, the warp threads made of hard plastic fiber are uncomfortable for skin when used; and (ii) the elastic band is easy to deformation after used, which will seriously affect the user's wearing and cause discomfort. Therefore, there remains a need for a new and improved design for an elastic band to overcome the problems presented above.

SUMMARY OF THE INVENTION

The present invention provides an elastic band comprising an elastic weaving body, and a three-dimensional protruding surface is knitted on a front surface of the elastic weaving body while a flat plush surface is knitted on a rear surface thereof. The elastic weaving body is woven by a plurality of elastic warp threads, an elastic front weft thread, an elastic rear weft thread, and a plurality of non-elastic knitting warp threads. The elastic warp threads are positioned in parallel, and each of the elastic warp threads is arranged in successive S-shape in longitudinal direction, and the front weft thread and the rear weft thread are respectively woven on the front side and the rear side of the elastic warp threads. The front weft thread and the rear weft thread are arranged in parallel, and each of the front weft thread and the rear weft thread is transversely knitted back and forth to form a successive S-shape on the elastic weaving body. Each of the front weft thread and the rear weft thread is woven together with the elastic warp threads through the knitting warp threads to form the elastic weaving body. In the weaving process of the three-dimensional protruding surface on the front surface of the elastic weaving body, a plurality of wool yarns are woven along the direction of each elastic warp thread, and each of the wool yarns is configured to repeatedly weave with one row and span at least two rows of the front weft thread to form a plurality of protruding portions in sequence. At the same time of the weaving process of the three-dimensional protruding surface, each of wool yarns woven along the direction of each elastic warp thread on the rear surface of the elastic weaving body is sequentially interlaced with the rows of the rear weft thread to form a plurality of plush portions in order.

In one embodiment, in the weaving process of the three-dimensional protruding surface, excluding the head and tail ends of the wool yarn which are respectively knitted with the front weft thread, the other portions of the wool yarn are knitted with both of the front weft thread and the elastic warp thread.

In another embodiment, in the weaving process of the three-dimensional protruding surface, each of the wool yarns is configured to repeatedly weave with one row and span three rows of the front weft thread to form the protruding portions in sequence.

In still another embodiment, the three-dimensional protruding surface and the flat plush surface are woven on and fully cover the front and rear surfaces of the elastic weaving body respectively.

In a further embodiment, the areas of the three-dimensional protruding surface and the flat plush surface are respectively smaller than the front and rear surfaces of the elastic weaving body, and the three-dimensional protruding surface is woven on the middle area of the front surface of the elastic weaving body, and two lateral areas adjacent to two lateral edges of the front surface of the elastic weaving body are respectively reserved as two seaming portions.

In still a further embodiment, the area of the flat plush surface is larger than that of the three-dimensional protruding surface.

In a particular embodiment, in the weaving process of the knitting warp threads, each of hollow buffer spaces is reserved between each two knots to limit the stretched length of the elastic warp thread, the front weft thread, or the rear weft thread, so as to prevent the elastic warp thread, the front weft thread, or the rear weft thread from overstretch and being broken.

Comparing with conventional elastic band, the present invention is advantageous because: (i) the three-dimensional protruding surface comprises the protruding portions separated with the same interval, and when the elastic band is in use, the protruding portions not only can improve the friction coefficient of the surface so as to avoid the elastic band from loosen, but also can be used as ribs on the elastic weaving body to prevent the elastic band from being folded and to keep the elastic band smooth; (ii) a plurality of recesses formed between the protruding portions are adapted to achieve the effect of ventilation; and (iii) the three-dimensional protruding surface and the flat plush surface can provide extra soft touch for skin and have the effect of reducing pressure, which greatly improves comfort to wear.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
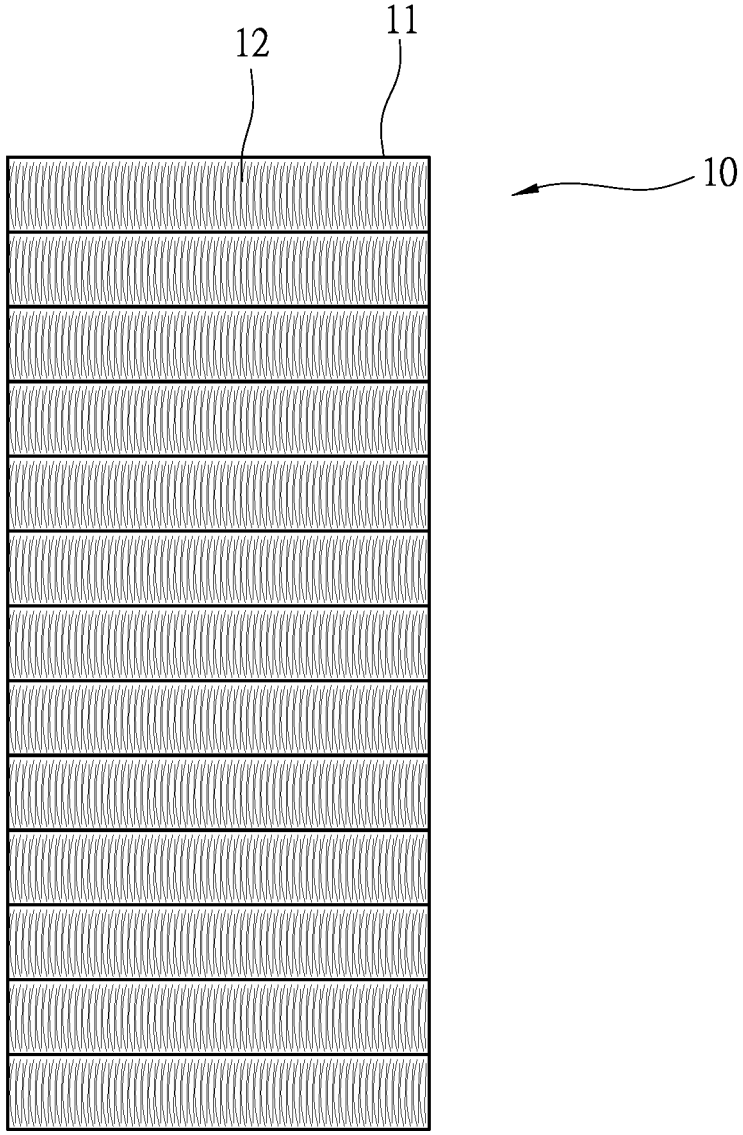
FIG. 1 is a plan view of an elastic band of the present invention.
Figure 2:
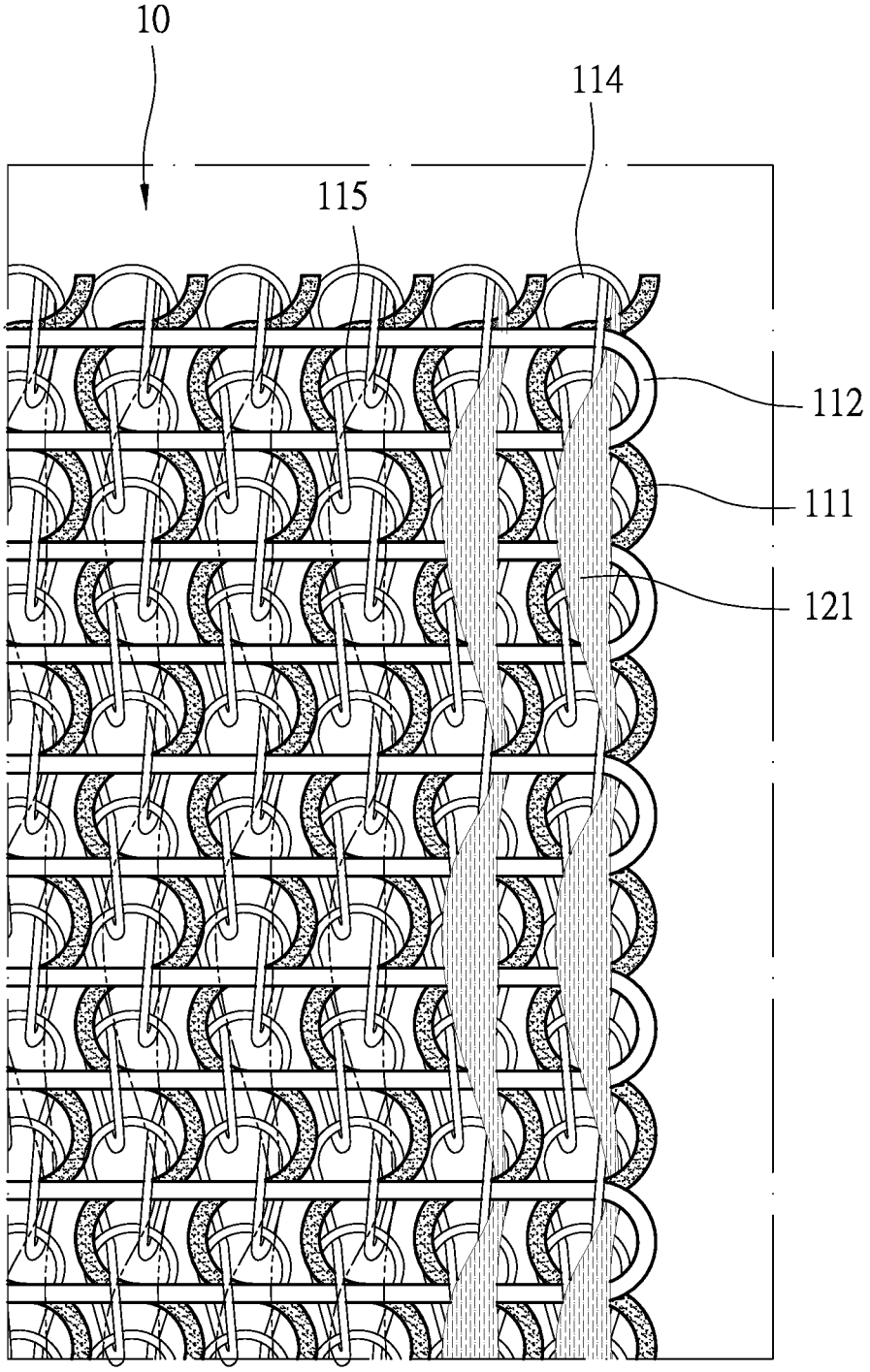
FIG. 2 is a detailed enlarged view illustrating the weaving structure of the elastic band in the present invention.
Figure 3:
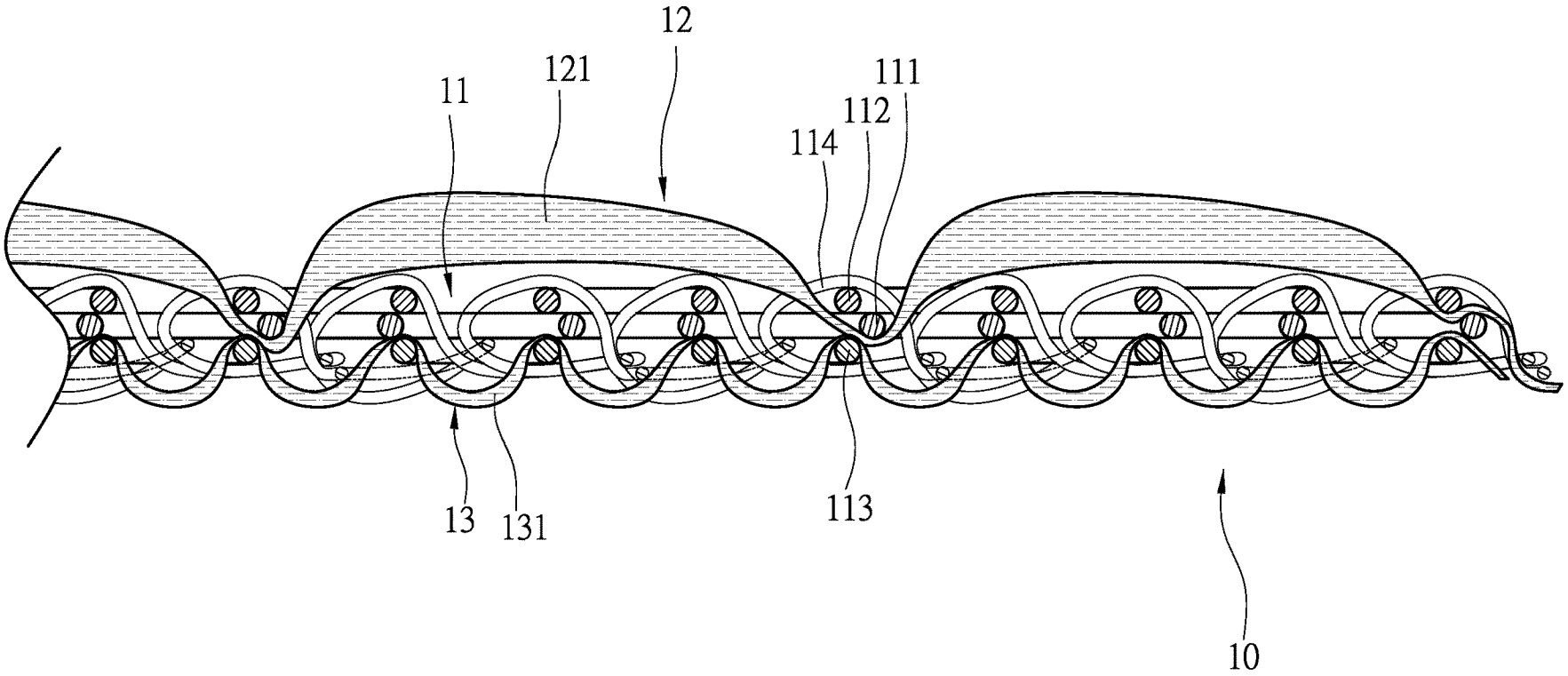
FIG. 3 is a sectional detailed enlarged view illustrating the weaving structure of the elastic band in the present invention.

In order to further understand the goal, characteristics and effect of the present invention, a number of embodiments along with the drawings are illustrated as following:

Referring to FIGS. 1 to 3, the present invention provides an elastic band (10) comprising an elastic weaving body (11), and a three-dimensional protruding surface (12) is knitted on a front surface of the elastic weaving body (11) while a flat plush surface (13) is knitted on a rear surface thereof. The elastic weaving body (11) is woven by a plurality of elastic warp threads (111), an elastic front weft thread (112), an elastic rear weft thread (113), and a plurality of non-elastic knitting warp threads (114). The elastic warp threads (111) are positioned in parallel, and each of the elastic warp threads (111) is arranged in successive S-shape in longitudinal direction, and the front weft thread (112) and the rear weft thread (113) are respectively woven on the front side and the rear side of the elastic warp threads (111). More specifically, the front weft thread (112) and the rear weft thread (113) are arranged in parallel, and each of the front weft thread (112) and the rear weft thread (113) is transversely knitted back and forth to form a successive S-shape on the elastic weaving body (11). Furthermore, each of the front weft thread (112) and the rear weft thread (113) is woven together with the elastic warp threads (111) through the knitting warp threads (114) to form the elastic weaving body (11). In the weaving process of the three-dimensional protruding surface (12) on the front surface of the elastic weaving body (11), a plurality of wool yarns are woven along the direction of each elastic warp thread (111), and each of the wool yarns is configured to repeatedly weave with one row and span at least two rows of the front weft thread (112) to form a plurality of protruding portions (121) in sequence. Meanwhile, at the same time of the weaving process of the three-dimensional protruding surface (12), each of wool yarns woven along the direction of each elastic warp thread (111) on the rear surface of the elastic weaving body (11) is sequentially interlaced with the rows of the rear weft thread (113) to form a plurality of plush portions (131) in order.

In one embodiment, in the weaving process of the three-dimensional protruding surface (12), excluding the head and tail ends of the wool yarn which are respectively knitted with the front weft thread (112), the other portions of the wool yarn are knitted with both of the front weft thread (112) and the elastic warp thread (111).

In another embodiment, in the weaving process of the three-dimensional protruding surface (12), each of the wool yarns is configured to repeatedly weave with one row and span three rows of the front weft thread (112) to form the protruding portions (121) in sequence.

In still another embodiment, the three-dimensional protruding surface (12) and the flat plush surface (13) are woven on and fully cover the front and rear surfaces of the elastic weaving body (11) respectively.

In a further embodiment, in the weaving process of the knitting warp threads (114), each of hollow buffer spaces (115) is reserved between each two knots to limit the stretched length of the elastic warp thread (111), the front weft thread (112), or the rear weft thread (113), so as to prevent the elastic warp thread (111), the front weft thread (112), or the rear weft thread (113) from overstretch and being broken.

Figure 4:
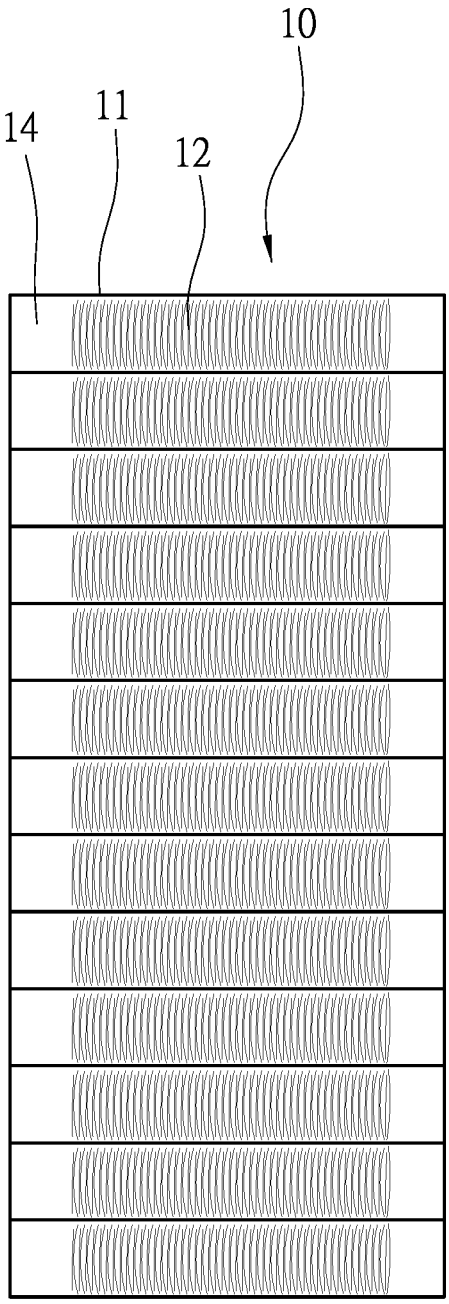
FIG. 4 is a front view of a second embodiment of the elastic band in the present invention.
Figure 5:
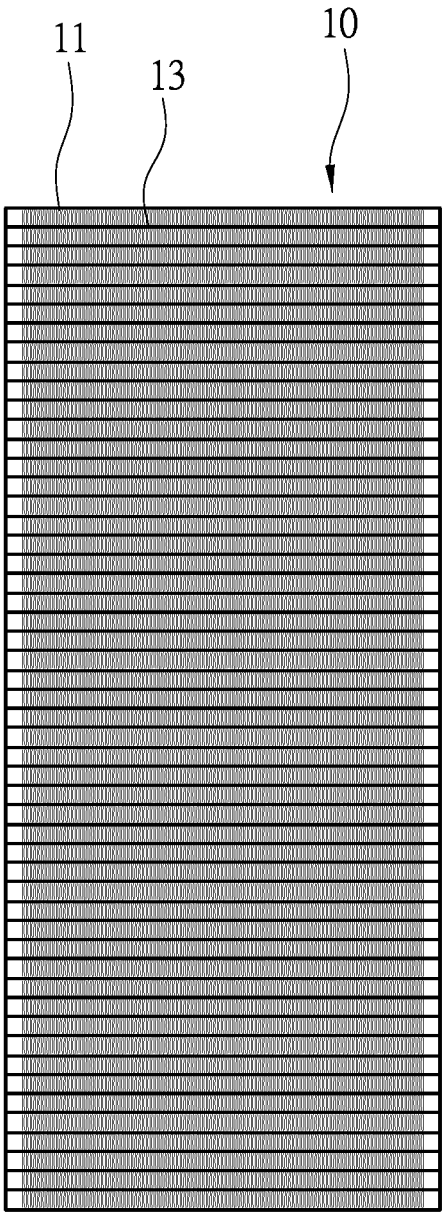
FIG. 5 is a rear view of the second embodiment of the elastic band in the present invention.

In a particular embodiment, referring to FIGS. 4 and 5, the areas of the three-dimensional protruding surface (12) and the flat plush surface (13) are respectively smaller than the front and rear surfaces of the elastic weaving body (11), and the three-dimensional protruding surface (12) is woven on the middle area of the front surface of the elastic weaving body (11), and two lateral areas adjacent to two lateral edges of the front surface of the elastic weaving body (11) are respectively reserved as two seaming portions (14), and the area of the flat plush surface (13) is larger than that of the three-dimensional protruding surface (12).

Structurally, the elastic band (10) comprises the elastic weaving body (11), and the front surface and the rear surface of the elastic weaving body (11) respectively have the three-dimensional protruding surface (12) and the flat plush surface (13). Also, the three-dimensional protruding surface (12) comprises the protruding portions (121) separated with the same interval. When the elastic band (10) is in use, the protruding portions (121) not only can improve the friction coefficient of the surface so as to avoid the elastic band (10) from loosen, but also can be used as ribs on the elastic weaving body (11) to prevent the elastic band (10) from being folded and to keep the elastic band (10) smooth. Moreover, a plurality of recesses formed between the protruding portions (121) are adapted to achieve the effect of ventilation.

Furthermore, the three-dimensional protruding surface (12) and the flat plush surface (13) can provide extra soft touch for skin and have the effect of reducing pressure, which greatly improves comfort to wear.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. An elastic band comprising an elastic knitted body, and a three-dimensional protruding surface knitted on a front surface of the elastic knitted body while a flat surface knitted on a rear surface thereof;

wherein the elastic knitted body is generated by a plurality of elastic warp threads, an elastic front weft thread, an elastic rear weft thread, and a plurality of non-elastic knitting warp threads; the elastic warp threads are positioned in parallel, and each of the elastic warp threads is arranged in successive S-shape in longitudinal direction, and the front weft thread and the rear weft thread are respectively knitted on the front side and the rear side of the elastic warp threads; the front weft thread and the rear weft thread are arranged in parallel, and each of the front weft thread and the rear weft thread is transversely knitted back and forth to form a successive S-shape on the elastic knitted body; each of the front weft thread and the rear weft thread is knitted together with the elastic warp threads through the knitting warp threads to form the elastic knitted body; in the knitting process of the three-dimensional protruding surface on the front surface of the elastic knitted body, a plurality of wool yarns are knitted along the direction of each elastic warp thread, and each of the wool yarns is configured to repeatedly knit with a row and span at least two rows of the front weft thread to form a plurality of protruding portions in sequence; at the same time of the knitted process of the three-dimensional protruding surface, each of wool yarns knitted along the direction of each elastic warp thread on the rear surface of the elastic knitted body is sequentially interlaced with rows of the rear weft thread to form a plurality of portions in order.

2. The elastic band of claim 1, wherein in the knitted process of the three-dimensional protruding surface, excluding head and tail ends of the wool yarn which are respectively knitted with the front weft thread, the other portions of the wool yarn are knitted with both of the front weft thread and the elastic warp thread.

3. The elastic band of claim 1, wherein in the knitted process of the three-dimensional protruding surface, each of the wool yarns is configured to repeatedly knit with one row and span three rows of the front weft thread to form the protruding portions in sequence.

4. The elastic band of claim 1, wherein the three-dimensional protruding surface and the flat surface are woven on and fully cover the front and rear surfaces of the elastic knitted body respectively.

5. The elastic band of claim 1, wherein areas of the three-dimensional protruding surface and the flat surface are respectively smaller than the front and rear surfaces of the elastic knitted body, and the three-dimensional protruding surface is woven on a middle area of the front surface of the elastic knitted body.

6. The elastic band of claim 5, wherein the area of the flat surface is larger than that of the three-dimensional protruding surface.

7. The elastic band of claim 1, wherein in the knitted process of the knitting warp threads, a hollow buffer space is reserved to limit a stretched length of the elastic warp thread, the front weft thread, or the rear weft thread, so as to prevent the elastic warp thread, the front weft thread, or the rear weft thread from overstretch and being broken.

* * * * *